United States Patent [19]

Melocik

[11] Patent Number: 4,509,406

[45] Date of Patent: Apr. 9, 1985

[54] PRESSURE REDUCING VALVE FOR DEAD ENGINE LOWERING

[75] Inventor: Kurt B. Melocik, Mazon, Ill.

[73] Assignee: Caterpillar Tractor Co., Peoria, Ill.

[21] Appl. No.: 475,872

[22] Filed: Mar. 16, 1983

Related U.S. Application Data

[63] Continuation of Ser. No. 230,972, Jun. 16, 1980, abandoned.

[51] Int. Cl.[3] ..... F15B 11/08; F15B 13/042

[52] U.S. Cl. ..... 91/453; 91/461; 137/625.6

[58] Field of Search ..... 91/453, 461; 137/625-626; 251/26

[56] References Cited

U.S. PATENT DOCUMENTS

| | | | |
|---|---|---|---|
| 3,620,129 | 11/1971 | Fruehauf | 91/461 X |
| 3,698,415 | 10/1972 | Forster et al. | 137/102 |
| 3,766,944 | 10/1973 | Distler | 137/625.6 |
| 3,840,049 | 10/1974 | Field, Jr. | 137/625.63 |
| 3,935,792 | 2/1976 | Dezelan et al. | 91/461 X |
| 3,987,703 | 10/1976 | Latimer | 91/6 |
| 4,184,512 | 1/1980 | Pigndlet | 137/596 |

FOREIGN PATENT DOCUMENTS

| | | | |
|---|---|---|---|
| 1500300 | 5/1969 | Fed. Rep. of Germany . | |
| 2236101 | 1/1975 | France | 137/596 |

*Primary Examiner*—Irwin C. Cohen

*Attorney, Agent, or Firm*—Wood, Dalton, Phillips, Mason & Rowe

[57] ABSTRACT

A fluid system (10) having a directional control valve (12) operated by a pilot valve (11) having a manually operable control handle (22) for selectively controlling a fluid motor (14) in positioning a load (17). The pilot valve (11) includes a spool (31) cooperating with associated portions of the pilot valve to provide a pressure regulated pilot signal to the directional control valve during normal operation of the system. Spool (31) includes a recess (98) which is placed in communication with the high pressure portion of the motor cylinder (16) during a dead engine condition by manipulation of handle (22) to provide pressure regulated delivery of the fluid from the motor (14) through recess (98) and to the conduit normally controlling the directional control valve for effecting a controlled lowering or retraction of the load. A single pilot valve is utilized for effecting the pressure regulated control in both normal and dead engine conditions.

10 Claims, 3 Drawing Figures

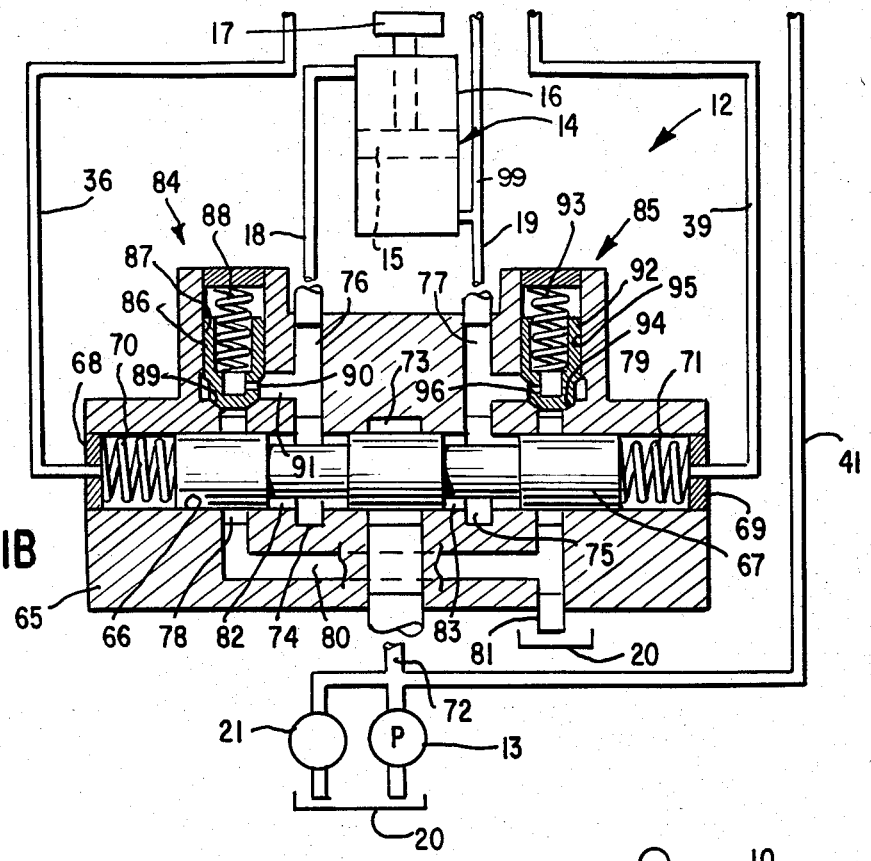
FIG. 1B
FIG. 2
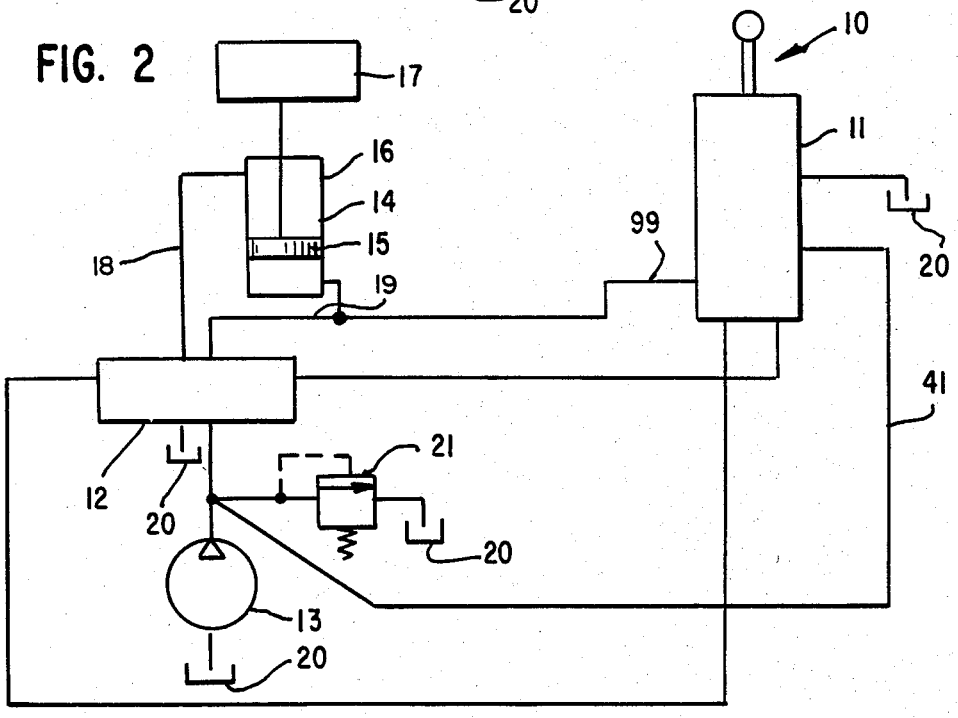

PRESSURE REDUCING VALVE FOR DEAD ENGINE LOWERING

This is a continuation of application Ser. No. 230,972 filed June 16, 1980, now abandoned.

TECHNICAL FIELD

This invention relates to fluid systems and in particular to fluid systems for controlling the raising and lowering of a load.

BACKGROUND ART

In U.S. Pat. No. 3,987,703 of Eugene E. Latimer, which patent is owned by the assignee hereof, a hydraulic control system is disclosed having a load-lifting hydraulic motor, a source of pressurized fluid, and a pilot-operated directional control valve for directing fluid for operation of the motor. The system is operative automatically upon failure of the main fluid pressure supply to provide pressurized fluid from the pressure side of the load-supporting motors for emergency pilot operation of the directional control valves.

Jesse L. Field, Jr., in U.S. Pat. No. 3,840,049, which patent is also owned by the assignee hereof, shows a control system for a fluid motor wherein the direction control valve includes a spool and means for selectively shifting the spool in response to fluid pressure signals from a manually operated pilot valve. The direction control valve includes make-up valve means for opening a bypass passage between the motor and the fluid return line when necessary to prevent cavitation of the motor such as due to an overrunning condition from the external load.

Josef Distler shows, in U.S. Pat. No. 3,766,944, a pilot controlled fluid flow regulating valve. The pilot valve has a body provided with inlet means connected to a pump or other suitable source of pressurized fluid, and port means connected to the chamber in the housing of the regulating valve. A valve member of the pilot valve is movable to control the flow of fluid between the inlet means and the port means. A control spring is mounted in the body of the pilot valve and is deformable to displace the valve member against the opposition of fluid pressure acting on the surface of the valve member.

Franz Forster et al., in U.S. Pat. No. 3,698,415, show a pressure regulating valve having a control member shiftable in a cylindrical bore of the bore housing by a manually operable lever. A plurality of springs are provided for interconnecting the control member and the valve body. One of the springs comes into play only after the control member has been displaced at least a predetermined amount.

DISCLOSURE OF INVENTION

The present invention is directed to overcoming one or more of the problems as set forth above.

The fluid system of the present invention includes an improved pressure regulating pilot valve which permits the operator to control the movement of the spool of the pilot valve by the operator handle so as to control the lowering or closing of auxiliary apparatus by the fluid motor at the control of the operator.

Concurrently with the control of the fluid motor, pressure regulation is effected by the pilot valve.

Thus, the fluid control of the present invention is advantageously adapted for use in controlling the retraction of the apparatus as in the event of a dead engine, so that the normal pressurized fluid supply is de-energized.

The invention comprehends the provision of such a pilot valve wherein the same spool which is utilized for providing pressure regulated signals to the directional control valve is utilized in the event of a dead engine for controlling the movement of the load as desired by the operator.

The valve operates during the dead engine control to provide pressure regulation generally in the same manner as during normal operation of the fluid system.

More specifically, the invention comprehends the provision in a fluid system having a reciprocable fluid motor, fluid supply means including a source of pressurized fluid, a pilot operated directional control valve for controlling delivery of the pressurized fluid to said motor for reciprocably operating the same, and a pilot valve for providing the pressurized fluid to the control valve at a predetermined regulated pressure. The pilot valve includes an inlet port connected to the source and an outlet port connected to the directional control valve for conducting the pressure regulated fluid to the control valve to controllably move the fluid motor in one direction. The pilot valve has a second inlet port connected to a load supporting end of the fluid motor. A spool is movable between a first position at which fluid from the first inlet port to the outlet port is regulated at the predetermined pressure and a second position at which fluid from the second inlet port to the outlet port is regulated at the predetermined pressure. The spool is movable from its first position to its second position only in the absence of pressurized fluid from said source.

The pilot valve, in the illustrated embodiment includes a spool and the means associated with the pilot valve comprises flow passage means responsive to movement of the spool for selectively preventing communication between the fluid motor and the port when the source is providing the pressurized fluid.

The valve is arranged to provide the desired communication between the fluid motor and the port as a result of controlled movement of the spool when the source is not providing the pressurized fluid.

The means associated with the pilot valve includes a manually operable actuator for selectively positioning the pilot valve in a first disposition for controlling regulated pressure fluid flow to the port when the source is providing the pressurized fluid and in a second disposition for controlling fluid flow from the fluid motor to the port when the source is not providing the pressurized fluid.

The valve is arranged to provide regulated pressure fluid flow in the second disposition.

Thus, in one aspect of the present invention, the pressure regulating pilot valve is arranged to provide controlled fluid flow from the fluid motor of a fluid system under dead engine conditions, while at the same time providing pressure regulation of the fluid flow.

The apparatus of the present invention is extremely simple and economical of construction while yet providing the highly desirable features discussed above.

BRIEF DESCRIPTION OF THE DRAWINGS

FIG. 1B is a sectional view illustrating the connection of the control valve to the pilot valve, the load, and the source of pressurized fluid; and FIG. 2 is a schematic diagram of the fluid system.

BEST MODE FOR CARRYING OUT THE INVENTION

Figure 1A:
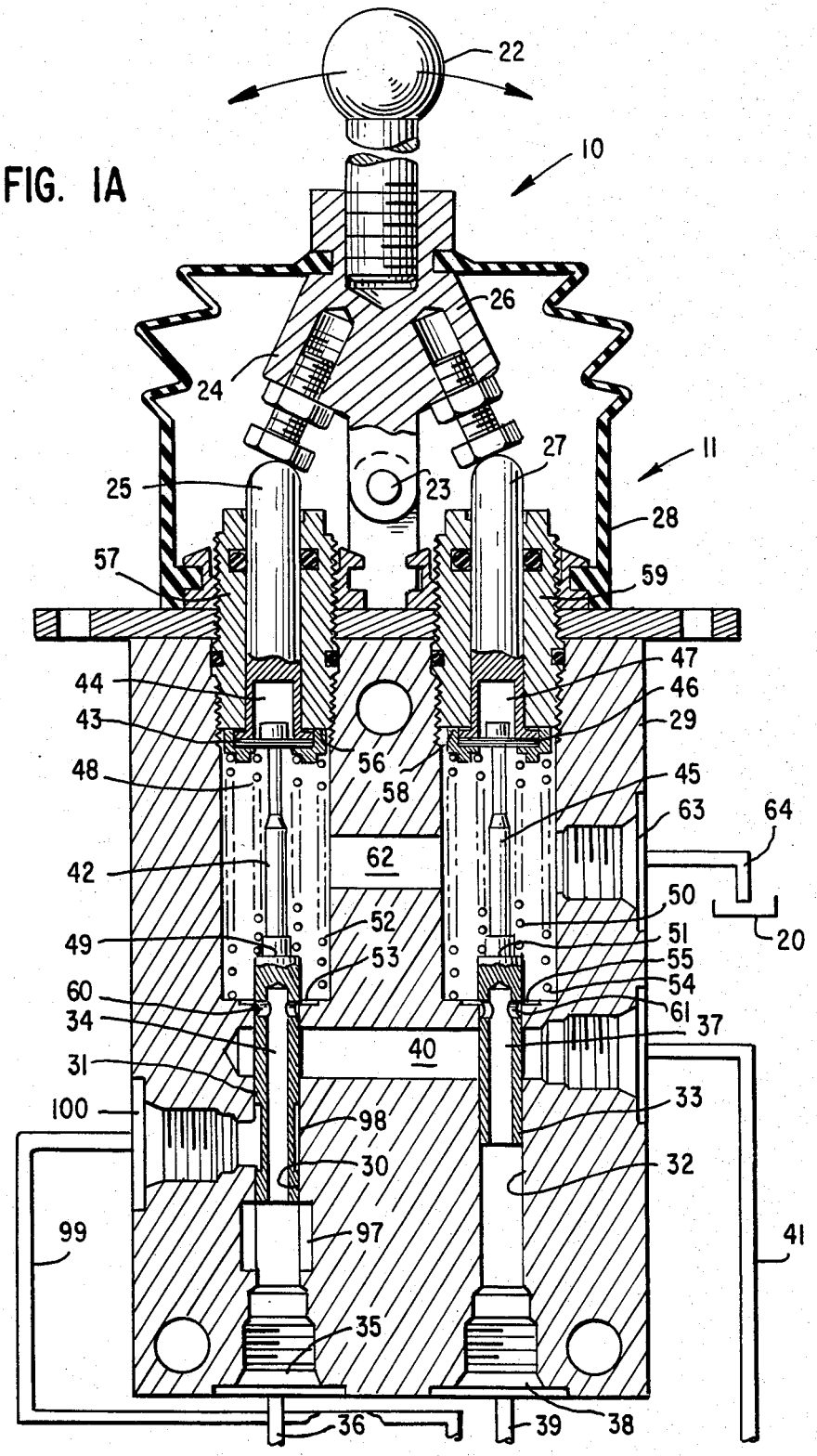
FIG. 1A is a sectional view of a pressure regulating pilot valve for use in a fluid system embodying the invention.

In the illustrated embodiment of the invention as disclosed in the drawing, a fluid system generally designated 10 is shown to include a pressure regulating pilot valve 11 controlling a directional control valve 12 for controlling delivery of pressurized fluid from a pump 13 to a fluid motor 14. The fluid motor illustratively may comprise a linear fluid motor including a piston 15 reciprocable in a cylinder 16 for lifting a load 17. A first fluid supply line 18 is connected to one end of the cylinder and a second fluid supply line 19 is connected to the other end. The system includes a reservoir tank 20 and a pressure regulating valve 21 for regulating the high pressure output of the pump 13.

Pilot valve 11 is controlled by a manually operable handle 22. Thus, as seen in FIG. 1A, the handle is swingable about a pivot 23 so as to urge a first actuating arm 24 against a plunger 25 and a second actuating arm 26 against a plunger 27 of the pilot valve. The handle is swingable within a housing 28 carried on wall means 29 defining the valve body.

Valve body 29 defines a first valve chamber 30 receiving a first movable valve member, or spool, 31, and a second valve chamber 32 receiving a second movable valve member, or spool, 33.

Spool 31 defines an axial, downwardly opening bore 34 communicating with an outlet port 35 connected to a transfer conduit 36. Spool 33 defines a similar axial bore 37 opening to an outlet port 38 connected to a transfer conduit 39.

Valve body 29 further defines a cross bore 40 defining an inlet passage connected through a supply conduit 41 to the pump 13.

As shown in FIG. 1A, spool 31 is provided with a stem 42 which extends upwardly through a connector 43 into a recess 44 at the lower end of plunger 25. Similarly, spool 33 is provided with an upwardly extending stem 45 extending through a connector 46 into a recess 47 in the lower end of plunger 27. A first coil spring 48 extends between connector 43 and a shoulder 49 on spool 31 for biasing the spool resiliently downwardly relative to the connector. Similarly, a coil spring 50 extends between connector 46 and a shoulder 51 on the spool 33 to bias the spool downwardly.

Connector 43 is biased upwardly by a coil spring 52 extending between the connector and a shoulder 53 on the valve body. Similarly, a second spring 54 biases the connector 46 upwardly, spring 54 extending between connector 46 and a shoulder 55 on the valve body. Thus, connector 43 is normally urged against a shoulder 56 of a plug 57 slidably carrying the plunger 25, and connector 46 is urged against a shoulder 58 on a plug 59 slidably carrying plunger 27.

Spool 31 is provided with radial ports 60 opening to axial passage 34 and spool 33 is provided with radial ports 61 opening to passage 37. As shown in FIG. 1A, ports 60 and 61 are normally spaced from the inlet passage 40. However, when plunger 25 or plunger 27 is suitably depressed by manipulation of handle 22, the corresponding connector 43 or 46 is moved downwardly against the action of spring 52 or spring 54 respectively, so as to permit the spools 31 and 33 to be resiliently moved downwardly by the action of the biasing springs 48 and 50, respectively. Thus, illustratively, when the handle 22 is swung to the left as seen in FIG. 1A, so as to depress plunger 25, spool 31 may be moved sufficiently downwardly to provide communication between the inlet passage 40 and the radial ports 60, thereby conducting pressurized fluid from the pump and supply conduit 41 through ports 60 and passage 34 of spool 31, outlet 35 and transfer conduit 36 to the directional control valve 12. The pressure of the fluid in outlet port 35 acting on the end of spool 31 opposes the bias of spring 48 to position the spool 31 to a first preselected position in response to fluid pressure in outlet port 35. An instantaneous preselected pressure level in outlet port 35 as established by the degree of input through handle 22 remains constant because any change of pressure in the outlet port 35 would result in an unbalance of force opposing the spring 48, resulting in movement of spool 31 to open or close port 60, thus maintaining the force balance between spring 48 and the force created by fluid pressure in the outlet port 35 acting on the end of spool 31. This action provides a pressure regulating function of the valve 10. A similar action occurs relative to ports 61 of spool 33 so as to provide pressure regulated fluid through transfer conduit 39 as a function of the positioning of handle 22 in a clockwise direction as seen in FIG. 1A.

As further shown in FIG. 1A, valve body 29 further defines an exhaust passage 62 connected through an exhaust port 63 and a conduit 64 to the tank reservoir 20. In the retracted position of spools 31 and 33, ports 60 and 61 thereof are in communication with the exhaust passage so that conduits 36 and 39 are normally vented when the handle 22 is in the neutral, centered position of FIG. 1A.

Referring now more specifically to FIG. 1B, directional control valve 12 defines a spool valve having a body 65 defining a valve chamber 66 in which is reciprocally mounted a spool 67. Conduit 36 opens through a closure 68 into one end of the chamber 66, and conduit 39 opens through a closure 69 into the opposite end of the chamber.

Spool 67 is centered in valve chamber 66 by a first biasing spring 70 extending between closure 68 and one end of the spool and a second biasing spring 71 extending between closure 69 and the opposite end of the spool. A high pressure supply conduit 72 is connected from pump 13 through the valve body 65 to an annular recess 73 at the midportion of chamber 66. A second annular recess 74 is spaced axially toward closure 68 from annular recess 73 and a second annular recess 75 is spaced axially in the opposite direction from the recess 73. Recess 74 is connected through a passage 76 to the fluid supply line 18 and recess 75 is connected through a passage 77 to the fluid supply line 19.

Outboard of annular recess 74, the valve body is provided with an exhaust annular recess 78 and outboard of the recess 75, the valve body is provided with a second annular recess 79. The exhaust recesses are connected through an exhaust passage 80 and exhaust conduit 81 to the reservoir tank 20.

Spool 67 is provided with a first annular, radially outwardly opening recess 82 which is in communication with body recess 74 and spaced from body recess 73 in the centered arrangement of the control valve 12, as shown in FIG. 1B. The spool is provided with a second annular, radially outwardly opening recess 83 in communication with recess 75 and out of communication with recess 73 when the spool is in the centered position of FIG. 1B.

Directional control valve 12 further defines a pair of make-up valves 84 and 85, respectively. Make-up valve 84 is defined by a movable valve member 86 received in a valve chamber 87 in valve body 65 and is normally biased by a spring 88 into seated relationship with a valve seat 89 opening to the recess 78. Valve member 86 defines a port 90 communicating the passage 76 with valve chamber 87 through a passage 91.

Make-up valve 85 is similar to make-up valve 84 and includes a valve member 92 biased by a spring 93 against a valve seat 94. The valve member 92 is received in a valve chamber 95 and is provided with a port 96.

In the normal operation of fluid system 10, delivery of the pressurized fluid to motor 14 is effected by suitable movement of the spool 67 of directional control valve 12 by selectively providing pressurized fluid through the pilot valve 11 and either of control conduits 36 or 39. Thus, if it is desired to move piston 15 of fluid motor 14 downwardly as seen in FIG. 1B, suitable manipulation of handle 22 of the pilot valve as shown in FIG. 1A, is effected to provide pressurized fluid through the spool passage 34 to transfer conduit 36, thereby applying pressure to the lefthand end of spool 67 of valve 12 and moving recess 82 to the right so as to provide communication between recess 73 and recess 74, thereby providing pressurized fluid from conduit 72 through the control valve to the supply line 18. At the same time, recess 83 is moved into communication with recess 79 so as to provide an exhaust connection from line 19 through the directional control valve to the exhaust conduit 81 and tank reservoir 20.

Conversely, when it is desired to move piston 15 upwardly as seen in FIG. 1B, pilot control handle 22 is moved in a clockwise direction so as to provide communication between supply passage 40 and spool passage 37 through port 61, thereby providing pressurized fluid through the transfer conduit 39 to the righthand end of the directional control valve and thereby moving spool 67 to the left, positioning recess 83 so as to provide communication between recess 73 and recess 75 of the valve body, thereby providing pressurized fluid from conduit 72 through passage 77 to transfer conduit 19. At the same time, spool recess 82 is moved to provide communication between recesses 74 and 78 of the valve body to provide an exhaust passage from conduit 18 to the exhaust conduit 81 and tank 20.

Thus, valve 11 functions as a pressure regulating pilot valve for selectively moving spool 67 of directional control valve 12 as a function of the movement of handle 22 of the pilot valve. Make-up valves 84 and 85 are provided for effectively preventing cavitation of fluid motor 14 such as when the load forces thereon tend to cause the piston 15 to move more rapidly than the flow of fluid from the pump 13 can provide through the lines 18,19. If for example, the cylinder 16 is retracting rapidly as noted above during a lower condition, the pressure in line 18 and passage 76 would drop. This drop in pressure is also felt in valve chamber 87 via valve chamber 91 and port 90. When the pressure in passage 76 drops below the tank pressure in exhaust passage 80 and annulus 78, the difference of pressure will act on the end of valve member 86 lifting it from its seat 89 thus providing make-up fluid to the cylinder 16 through passage 76 and line 18. Resultingly, fluid from conduit 19 is transferred through drain passage 80 into recess 78 and, thus, into passage 76 as a result of the unseating of valve member 86 from seat 89 to augment the fluid flow to the conduit 18 and, thus, effectively prevent cavitation of motor 14.

As indicated briefly above, the improved pressure regulating pilot valve 11 is arranged to provide an improved means for permitting the system to provide a controlled retraction of a load as upon the occurrence of a failure of the high pressure fluid supply system with the load in an extended arrangement such as in a raised condition. The control utilizes the pilot valve 11 to provide this desirable functioning in a novel and simple manner.

More specifically, as illustrated in FIG. 1A, pilot valve body 29 is further provided with an annular recess 97 spaced below the inlet passage 40. Pilot valve member 31 is provided with a recess 98 which is normally disposed between passage 40 and recess 97 of the valve body during the normal operation of the pilot valve in controlling the raising and lowering of the load. A conduit 99 is connected through a port 100 communicating with the recess 98, and as shown in FIG. 1B, conduit 99 is connected to conduit 19.

Thus, in the event of a failure of the high pressure pump 13 such as may result from a dead engine condition of the vehicle in which the pilot system 10 is provided, the control system may nevertheless be utilized to provide a controlled lowering of the load 17 through suitable manipulation of handle 22. More specifically, under such conditions, the pressure in the lower end of cylinder 16 is communicated through conduit 99 and port 100 to the recess 98 of the pilot valve spool 31. Manipulation of handle 22 in a counterclockwise direction as seen in FIG. 1A causes arm 24 to depress plunger 25 sufficiently to permit the pilot valve to move downwardly to a position wherein recess 98 communicates between port 100 and valve body recess 97. This communication permits the high pressure fluid from the head end of cylinder 16 to be conducted through the port 35 and conduit 36 to the left hand end of control valve 12, as seen in FIG. 1B, thereby moving the pilot valve 67 to the right for controlling the lowering of the load. As the pilot valve spool 31 is spring biased in this operation, reciprocal movement of the spool 31 relative to the upper edge of recess 97 may occur so as to provide pressure regulation of the fluid being passed from port 100 through recess 98 to body recess 97 and discharge port 35.

Thus, the pressure reducing spool 31 functions to provide such desirable pressure regulation not only during the normal operation of the system as when the pump 13 is operative to provide the desired operating pressure, but also provides desirable control and pressure regulation in a dead engine condition wherein the pressurized fluid of the motor 14 resulting from an extended disposition of the load at the time of the occurrence of the dead engine condition is utilized to provide pressure regulated control of the directional control valve in a substantially similar manner so as to provide accurate controlled lowering of the load as well under such dead engine conditions. The same spool that is utilized for controlling the pressure in normal operation is utilized in controlling the pressure and operation of the directional control valve in the dead engine condition and, thus, a substantially simplified and economical construction of the valving system is provided by the present invention.

The load may be any type of load desired to be positionally controlled by such a fluid system and while the invention is illustrated in connection with a raised load, as will be obvious to those skilled in the art, other forms of selectively extended loads, such as grasping jaw loads and the like, may be suitably controlled by system 10 in a like manner.

INDUSTRIAL APPLICABILITY

The control system of the present invention is advantageously adapted for a wide range of industrial applications. Illustratively, fluid motor 14 may be utilized in connection with a wide range of load-displacing apparatuses. In one example, the apparatus may comprise a loader having a bucket selectively raised by the motor 14.

More specifically, the fluid system is advantageously adapted for use in any industrial application where it is desired to lower a raised load controlled by a pilot operated system in the event the pressurized fluid source fails. The control system is utilized with a pilot valve for controlling the directional valve effecting the desired operation of the fluid motor and, thus, the system is advantageously adapted for use with a wide range of apparatuses utilizing such pilot controlled directional valves.

One group of apparatuses of such industrial applications is that of earthworking vehicles generally, one example of which is the loader discussed above. The fluid system of the invention is advantageously adapted for use with auxiliary devices associated with such earthworking vehicles.

Other aspects, objects and advantages of this invention can be obtained from a study of the drawings, the disclosure and the appended claims. The foregoing disclosure of specific embodiments is illustrative of the broad inventive concepts comprehended by the invention.

What is claimed is:

1. In a fluid system (10) having a reciprocable fluid motor (14), fluid supply means including a source of pressurized fluid (13), a pilot operated directional control valve (12) for controlling delivery of the pressurized fluid to said fluid motor for reciprocably operating the same, and a pilot valve (11) having a first inlet port (40) connected to said source, an outlet port (35) connected to said directional control valve, a spool (31) movable between a neutral position at which said spool blocks communication between the first inlet port and said outlet port and a first operational position at which said spool communicates the inlet port with said outlet port for conducting fluid from the source to said control valve to controllably move the fluid motor in one direction, a manually operable actuator (22) for selectively positioning said spool, and a spring positioned between the manually operable actuator and said spool, the improvement comprising:

fluid pressure responsive means on said spool to move said spool for providing pressure regulation of the fluid in the outlet port at the first operational position of the spool;

means in said pilot valve defining a second inlet port (100) connected to a load supporting end of said fluid motor; and said manually operable actuator and said fluid pressure responsive means defining means for causing said spool to move to a second operational position at which the spool communicates the second inlet port with the outlet port for conducting fluid from the load supporting end of said fluid motor to the control valve at the regulated pressure only in the absence of pressurized fluid from said source in said first inlet port.

2. The fluid system of claim 1 wherein said pilot valve (11) defines a transfer passage (97) in fluid communication with said outlet port (35), said spool defining an annular recess (98) in continuous fluid communication with said second inlet port (100), said annular recess (98) being blocked from fluid communication with said transfer passage (97) when the spool (31) is in its first operational position and in fluid communication with said transfer passage (97) when the spool (31) is in its second operational position.

3. In a fluid system (10) having a reciprocable fluid motor (14), and fluid supply means including a source of pressurized fluid (13), the improvement comprising:

a directional control valve (12) for controlling delivery of the pressurized fluid to said fluid motor for reciprocably operating the same; and a pilot valve (11) for controlling said directional control valve having a first inlet port (40) connected to said source, a second inlet port (100) connected to a load supporting end of said fluid motor, an outlet port (35) connected to said directional control valve, and means providing a pressure regulated output at said outlet port of fluid delivered thereto from either of said inlet ports, said pilot valve further defining fluid pressure responsive means permitting fluid delivery to said outlet port from said second inlet port responsive to the fluid pressure conditions existing at said first inlet port.

4. The fluid system of claim 3 including means for manually operating said pilot valve.

5. The fluid system of claim 3 wherein said means for providing a pressure regulated output includes spring-biased means.

6. In a fluid system (10) having a reciprocable fluid motor (14), and fluid supply means including a source of pressurized fluid (13), the improvement comprising:

a directional control valve (12) for controlling delivery of the pressurized fluid to said fluid motor for reciprocably operating the same; and a pilot (11) valve for controlling said directional control valve having a first inlet port (40) connected to said source, a second inlet port (100) connected to a load supporting end of said fluid motor, an outlet port (35) connected to said directional control valve, and means providing a pressure regulated output at said outlet port of fluid delivered thereto from either of said inlet ports, and fluid pressure responsive means permitting fluid delivery to said outlet port from said second inlet port as a function of the fluid pressure conditions existing at said first inlet port, said pilot valve further comprising a reciprocatively positionable spool, means defining a transfer passage (97) in fluid communication with said outlet port (35), said spool defining an annular recess (98) in continuous fluid communication with said second inlet port (100), said annular recess (98) being blocked from fluid communication with said transfer passage (97) when the spool (31) is in its first operational position.

7. In a fluid system (10) having a reciprocable fluid motor (14) and fluid supply means including a source of pressurized fluid (13), the improvement comprising:

a directional control valve (12) for controlling delivery of the pressurized fluid to said fluid motor for reciprocably operating the same; and a pilot valve (11) for controlling said directional control valve having a first inlet port (40) connected to said source, a second inlet port (100) connected to a load supporting end of said fluid motor, an outlet port (35) connected to said directional control valve, and means providing a pressure regulated output at said outlet port of fluid delivered thereto from either of said inlet ports, said pilot valve further defining fluid pressure responsive delivery means permitting fluid to said outlet port from said second inlet port only in the absence of fluid pressure at said first inlet port.

8. The fluid system of claim 7 including means for manually operating said pilot valve.

9. The fluid system of claim 7 wherein said means for providing a pressure regulated output includes spring-biased means.

10. In a fluid system (10) having a reciprocable fluid motor (14) and fluid supply means including a source of pressurized fluid (13), the improvement comprising:

a directional control valve (12) for controlling delivery of the pressurized fluid to said fluid motor for reciprocably operating the same; and a pilot valve (11) for controlling said directional control valve having a first inlet port (40) connected to said source, a second inlet port (100) connected to a load supporting end of said fluid motor, an outlet port (35) connected to said directional control valve, and means providing a pressure regulated output at said outlet port of fluid delivered thereto from either of said inlet ports, and fluid pressure responsive means permitting fluid delivery to said outlet port from said second inlet port only in the absence of fluid pressure at said first inlet port, said pilot valve further comprising a reciprocatively positionable spool, means defining a transfer passage (97) in fluid communication with said outlet port (35), said spool defining an annular recess (98) in continuous fluid communication with said second inlet port (100), said annular recess (98) being blocked from fluid communication with said transfer passage (97) when the spool (31) is in its first operational position and in fluid communication with said transfer passage (97) when the spool (31) is in its second operational position.

* * * * *